US005176526A

United States Patent [19]

Hillbish et al.

[11] Patent Number: 5,176,526

[45] Date of Patent: Jan. 5, 1993

[54] SHIELDED STACKING ELECTRICAL CONNECTOR ASSEMBLY

[75] Inventors: Warren C. Hillbish, Hummelstown; John W. Kaufman, Hershey, both of Pa.

[73] Assignee: AMP Incorporated, Harrisburg, Pa.

[21] Appl. No.: 914,180

[22] Filed: Jul. 14, 1992

[51] Int. Cl.[5] ..... H01R 13/652

[52] U.S. Cl. ..... 439/108; 439/74; 439/607

[58] Field of Search ..... 439/74, 101, 108, 607, 439/609

[56] References Cited

U.S. PATENT DOCUMENTS 4,909,746 3/1990 Scholz ..... 439/74 X 5,057,028 10/1991 Lemke et al. ..... 439/108 X

*Primary Examiner*—Eugene F. Desmond

[57] ABSTRACT

An electrical connector assembly includes a receptacle member (14) and a pin shroud member (16) adapted to be mounted to opposite sides of a printed circuit board. Each receptacle member (14) is adapted to mate with a pin shroud member (16) mounted to another circuit board so that a parallel stack of circuit boards may be interconnected and supported. Each pin shroud member (16) has ground shields (60) which engage terminals (42) in the mating receptacle member (14). The ground shield (60) and the engaged terminal members (42) have pin portions (62, 64) extending through apertures of the respective circuit boards for connection to ground planes on the circuit boards. Each receptacle member (14) is also provided with further terminal members (36) having portions (38) which extend through respective apertures (35) in the circuit board and through the pin shroud member (16) mounted to the opposite side of the circuit board for engagement with corresponding terminal members (36) of a receptacle member (14) mounted to another circuit board, which latter receptacle member (14) is mated with the pin shroud member (16).

6 Claims, 5 Drawing Sheets

SHIELDED STACKING ELECTRICAL CONNECTOR ASSEMBLY

BACKGROUND OF THE INVENTION

This invention relates to electrical connector assemblies and, more particularly, to an electrical connector assembly which functions to provide electrical interconnections between circuit boards, provide shielding for the connections, and provide support for circuit boards which are arrayed in a stacked parallel configuration.

In large electronic systems, such as computers and the like, it is common practice to provide a mother board, or backplane, to which a plurality of daughter boards are mounted and electrically interconnected. Traditionally, right angle connector assemblies have been utilized so that the daughter boards extend orthogonal to the mother board. U.S. Pat. No. 5,104,329 discloses an electrical connector assembly which provides for such orthogonal mounting and in addition provides shielding for the connections between the mother board and each daughter board. However, there are applications where the daughter boards and the mother board are to be supported in a stacked parallel configuration. An advantage of such a configuration is that a lower profile can be attained. Also, even though a plurality of daughter boards are connected orthogonally to a mother board, it may be desirable to interconnect the parallel daughter boards directly, rather than have such interconnections pass through the mother board.

It is therefore a primary object of the present invention to provide an electrical connector assembly which supports and electrically interconnects a plurality of circuit boards in a stacked parallel configuration.

It is a further object of this invention to provide an electrical connector assembly of the type described wherein continuous ground protection and shielding is provided between all of the boards in the stack.

SUMMARY OF THE INVENTION

The foregoing, and additional, objects are attained in accordance with the principles of this invention by providing a connector assembly for interconnecting a plurality of circuit boards in a stacked parallel configuration. Each of the circuit boards is formed with an array of apertures therethrough which are located on the boards so that the apertures of the plurality of circuit boards are mutually registered when the plurality of circuit boards are positioned in the stacked parallel configuration. The connector assembly comprises a receptacle member and a pin shroud member. The receptacle member includes a housing having a mating face, a mounting face, a transverse wall extending along the mounting face, an inner body portion and at least one outer side wall extending from the mounting face to the mating face and defining at least one elongated cavity between the inner body portion and the outer side wall. Means are provided for mounting the housing to a first of the plurality of circuit boards with the mounting face engaging a first surface of the first circuit board. The inner body portion has a plurality of terminal-receiving passageways extending therethrough from the mating face to the mounting face, with each of the passageways being aligned with a respective one of the apertures through the first circuit board when the housing is mounted to the first circuit board. There is provided a plurality of first contact terminal members, each disposed in a respective terminal-receiving passageway of the inner body portion. Each of the first contact terminal members has an elongated pin portion extending beyond the mounting face and through a respective aperture of the first circuit board when the housing is mounted to the first circuit board. Each of the first contact terminal members also has a pin receiving portion exposed along the mating face of the housing for mating with a corresponding pin portion from a second receptacle member mounted to a second of the plurality of circuit boards. There is also provided as part of the receptacle member a plurality of second contact terminal members disposed in the transverse wall and each having a terminal portion extending into the elongated cavity. The pin shroud member includes a housing having a mating face, a mounting face, and at least one wall extending from the mating face to the mounting face. Means are provided for mounting the pin shroud member housing to the first circuit board with the mounting face of the pin shroud member engaging a second surface of the first circuit board opposite the mounting face of the receptacle member housing mounted to the first surface of the first circuit board. The wall of the pin shroud member housing surrounds the pin portions which extend through the circuit board apertures from the receptacle member mounted to the first surface of the first circuit board. The pin shroud member also includes at least one ground shield member disposed along the outer periphery of the pin shroud member housing wall. The pin shroud member housing wall is adapted to be received in the elongated cavity of a third receptacle member mounted to a third of the plurality of circuit boards so that the ground shield member engages the terminal portions of the second contact terminal members of the third receptacle member when the pin shroud member and the third receptacle member are mated to interconnect the first and third circuit boards.

In accordance with an aspect of this invention, the ground shield member includes a plurality of spaced pin portions extending through respective apertures of the first circuit board for connection to a ground plane on the first circuit board and each of the second contact terminal members further includes a pin portion extending beyond the mounting face of the receptacle member housing and through a respective aperture of the first circuit board for connection to the ground plane on the first circuit board. The apertures for the ground shield member pin portions are interleaved with the apertures for the pin portions of the second contact terminal members.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
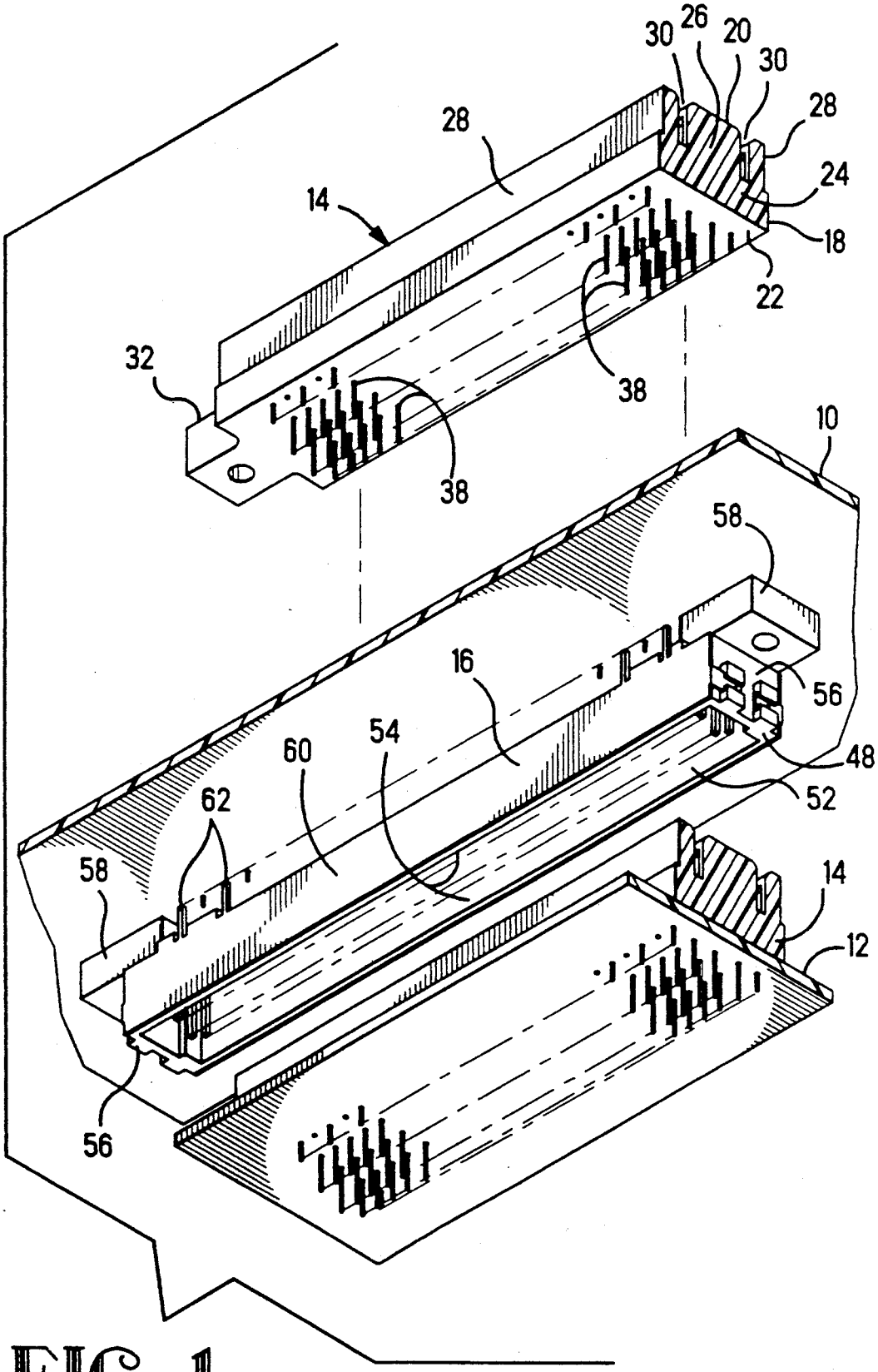
FIG. 1 is an exploded perspective view showing an electrical connector assembly according to this invention and illustrating how circuit boards are interconnected thereby.
Figure 2:
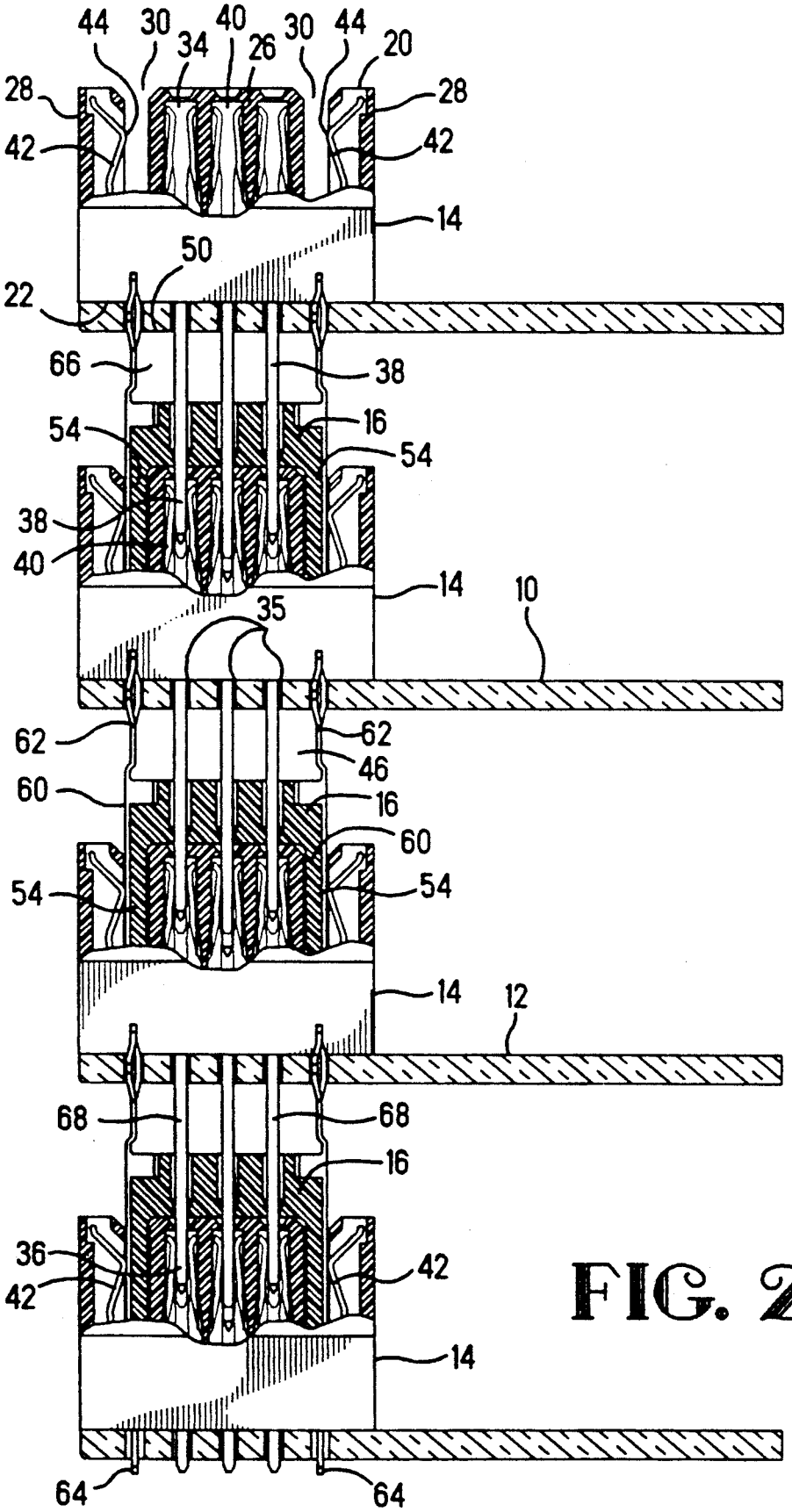
FIG. 2 is a side view, partially in cross section, showing a plurality of circuit boards in a stacked parallel configuration supported and interconnected by electrical connector assemblies according to this invention.
Figure 3:
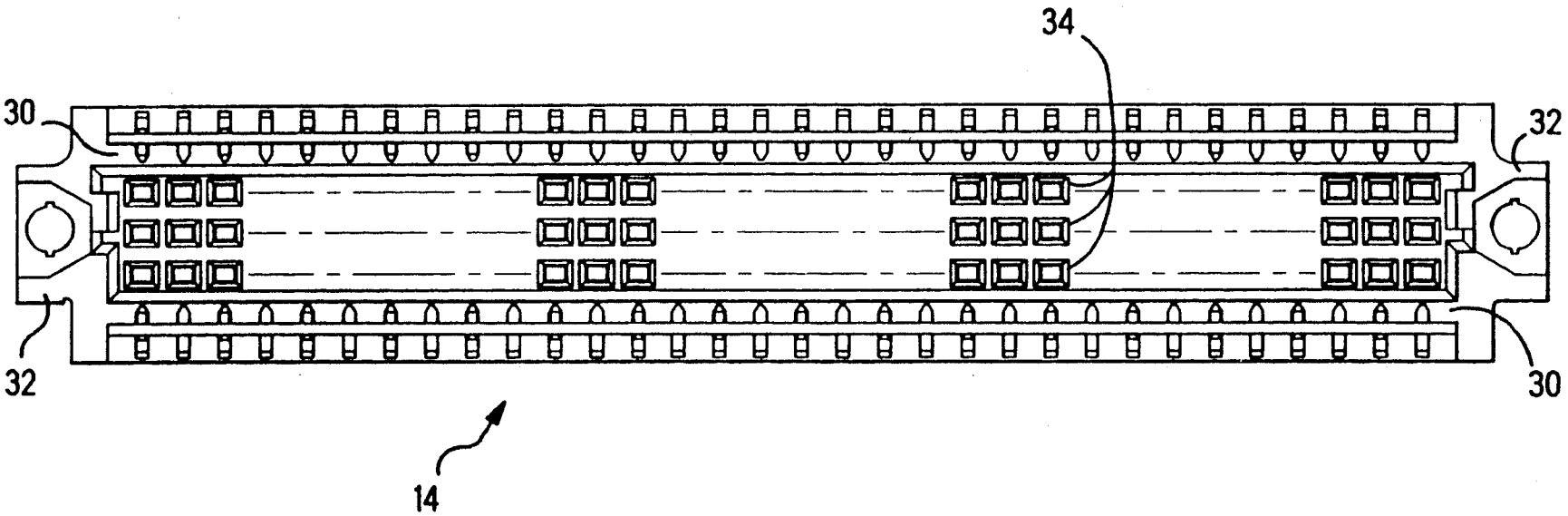
FIG. 3 is a top plan view of the receptacle member of an electrical connector assembly according to this invention.
Figure 4:
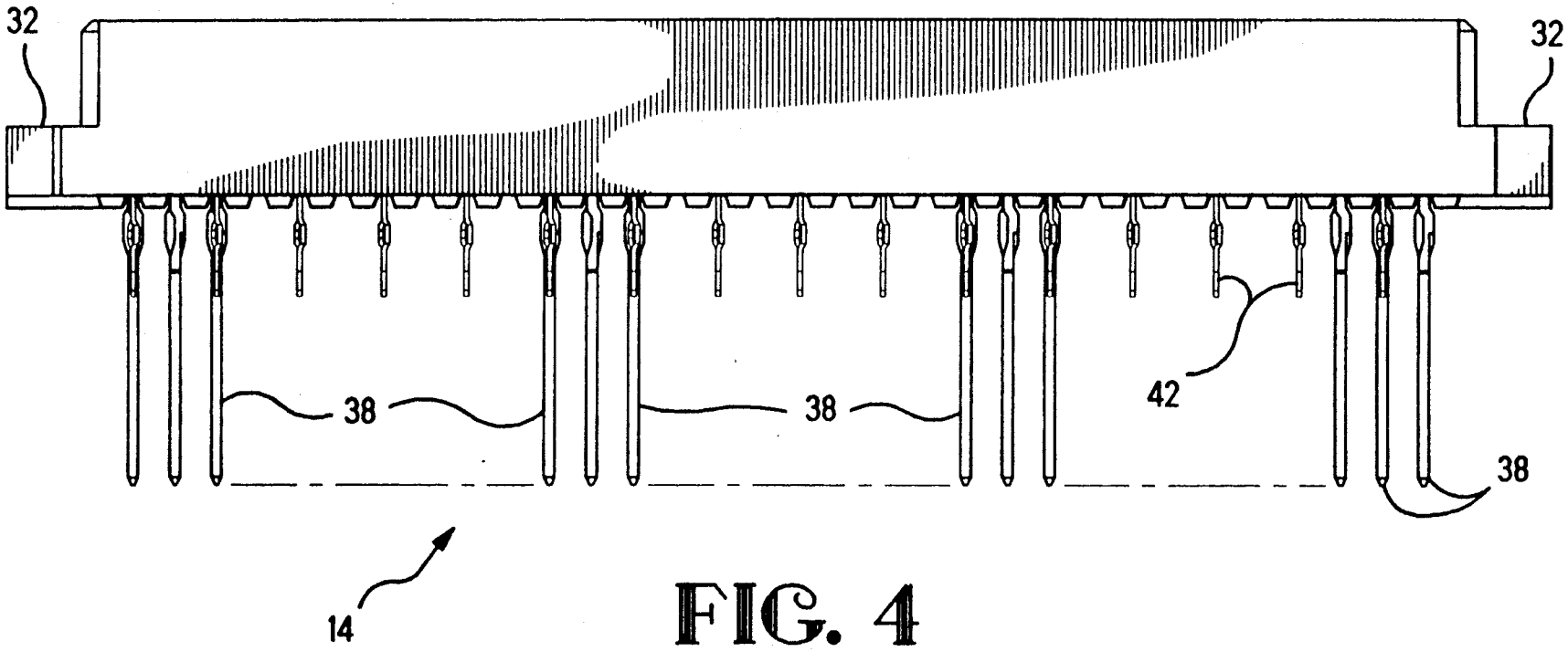
FIG. 4 is a side view of the receptacle member of FIG. 3.
Figure 5:
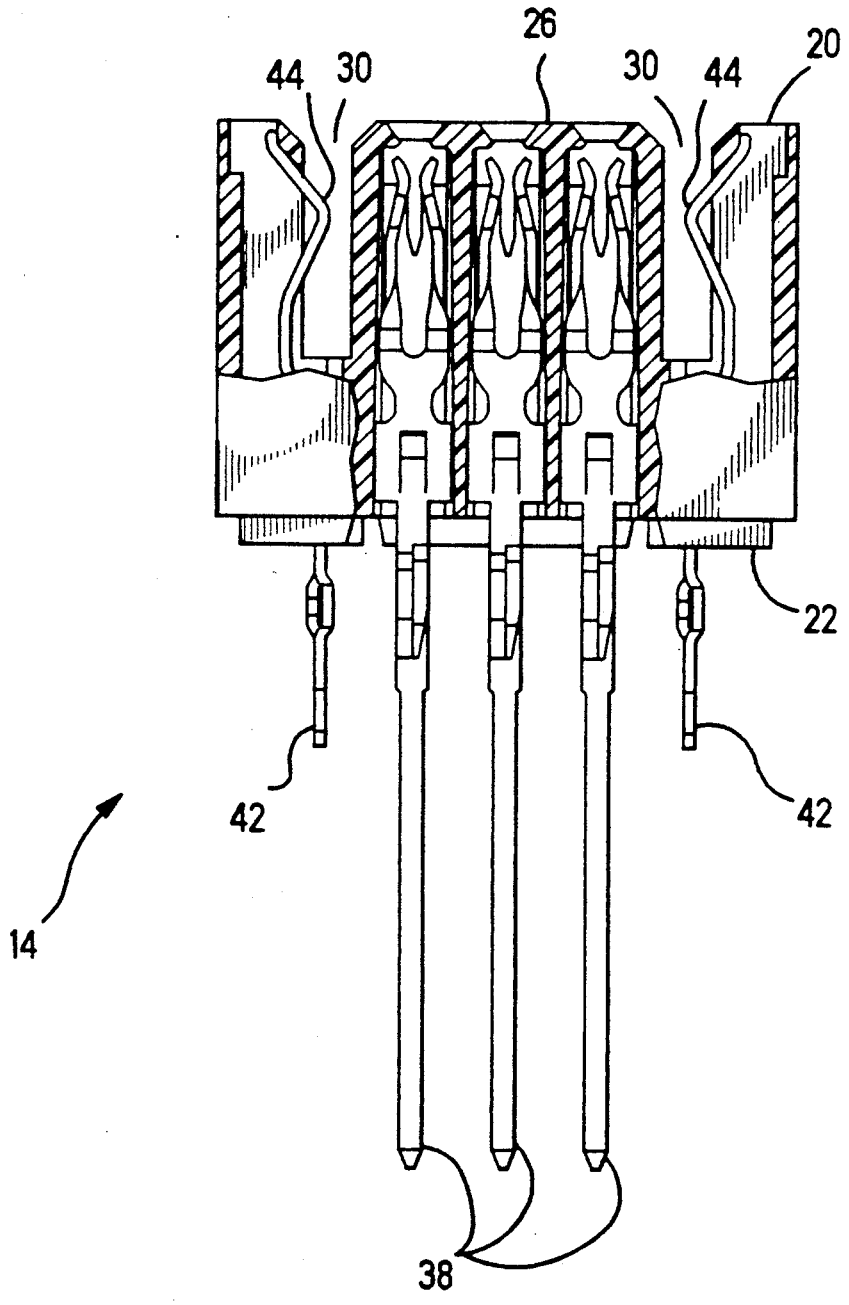
FIG. 5 is a partially sectioned end view of the receptacle member of FIG. 4.

Referring to the drawings, FIG. 1 shows a portion of a circuit board 10 and a portion of a circuit board 12 which are supported in a stacked parallel configuration and electrically interconnected by means of electrical connector assemblies according to this invention. Each of the circuit boards 10, 12 is formed with a plurality of apertures (not shown in FIG. 1 but some of which are shown in FIG. 2) which are located on the boards 10, 12 so that when the boards 10, 12 are stacked, the apertures are mutually registered (i.e., aligned). Each of the electrical connector assemblies includes a receptacle member 14 and a pin shroud member 16. The receptacle member 14 and the pin shroud member 16 are designed to mate with each other so that the boards 10, 12, as well as additional boards, may be electrically interconnected and supported in a stacked parallel configuration.

The receptacle member 14 includes a housing 18 having a mating face 20 and a mounting face 22, with a transverse wall 24 extending along the mounting face 22. The housing 18 further includes an inner body portion 26 and outer side walls 28 extending from the mounting face 22 to the mating face 20 and defining elongated cavities 30 between the inner body portion 26 and the outer side walls 28. A pair of mounting flanges 32 are formed as part of the receptacle member 14 and integral with the housing 18 for mounting the housing 18 to a circuit board 10, 12 with the mounting face 22 engaging a first surface of the circuit board. The inner body portion 26 is formed with a plurality of terminal-receiving passageways 34 which extend through the inner body portion 26 from the mating face 20 to the mounting face 22. Each of the passageways 34 is aligned with a respective one of the apertures 35 through the circuit board when the housing 18 is mounted to the circuit board. A plurality of first contact terminal members 36 is provided, each being disposed in a respective passageway 34 of the inner body portion 26. Each of the first contact terminal members 36 includes an elongated pin portion 38 which extends beyond the mounting face 22 and through a respective aperture 35 of the circuit board when the housing 18 is mounted to the circuit board. Each of the first contact terminal members 36 further includes a pin receiving portion 40 exposed along the mating face 20 for mating with the corresponding pin portion 38 from a second receptacle member mounted to another one of the circuit boards 10, 12.

There is also provided a plurality of second contact terminal members 40 disposed in the transverse wall 24 and having terminal portions extending into a respective one of the cavities 30.

Each pin shroud member 16 includes a housing 46 with a mating face 48 and a mounting face 50. The housing 46 further includes at least one wall 52 extending from the mating face 48 to the mounting face 50 and surrounding a defined space. Thus, the wall 52 can form a closed loop and can be curvilinear or rectilinear, or any combination thereof. Preferably, as illustrated in the drawings, the wall 52 includes two parallel wall segments 54, joined by transverse wall segments 56 to enclose the defined space. Each of the parallel wall segments 54 is adapted to be received in a respective one of the elongated cavities 30 of the receptacle member 14, as best illustrated in FIG. 2.

The pin shroud member 16 is provided with mounting flanges 58 extending outwardly from, and integral with, the housing 46 for mounting the housing 46 to a second surface of a circuit board with the mounting face 50 engaging that second surface. The pin shroud member 16 is positioned on the second surface of the circuit board so that the pin portions 38 of the first contact terminal members 36 of the receptacle member 14 which extend through the circuit board apertures 35 from the receptacle member 14 mounted to the other side of the circuit board extend through the defined space surrounded by the wall 52.

The pin shroud member 16 further includes a pair of ground shield plates 60 each disposed along the outer periphery of a respective one of the parallel wall segments 54. Since each of the parallel wall segments 54 is adapted to be received into a respective one of the elongated cavities 30 of a receptacle member 14, each ground shield plate 60 then engages the terminal portions 44 of the second contact terminal members 42 extending into that elongated cavity 30.

Each ground shield plate 60 includes a plurality of spaced pin portions 62 which extend through respective apertures of the circuit board to which the pin shroud member 16 is mounted. Also, each of the second contact terminal members 42 includes a pin portion 64 extending beyond the mounting face 22 and through a respective aperture of the circuit board to which the receptacle member 14 is mounted. Further, the apertures for the ground plate pin portions 62 are interleaved with the apertures for the pin portions 64 of the second contact terminal members 42. As is known, each of the printed circuit boards 10, 12 is formed with a ground plane. The aforementioned apertures through the circuit boards are plated, with the ground plane being connected to the plating of the apertures containing the pin portions 62, 64. Accordingly, all of the ground shield plates 60 and the second contact terminal members 42 are electrically connected with each other and with the ground planes of the circuit boards 10, 12.

The pin shroud member 16 is further formed with a transverse wall 66 extending along the mounting face 50 within the defined space surrounded by the wall 52. The transverse wall 66 is formed with a plurality of passageways 68 which are transverse to the mounting face 50 and which are so positioned and spaced to be in registration with respective apertures 35 of the circuit board so that each of the pin portions 38 which extends through a circuit board aperture 35 passes through a respective passageway 68. The passageways 68 function to hold and align the pin portions 38 for their subsequent mating with the pin receiving portions 40 of the next receptacle member 14 of the stack.

As best shown in FIG. 2, circuit boards may be stacked endlessly by providing each of the circuit boards with a receptacle member 14 mounted on a first surface thereof and a pin shroud member 16 mounted on a second surface thereof. Each receptacle member 14 mates with a pin shroud member 16 of the next vertically disposed circuit board, when viewed as in FIG. 2. This mating provides mechanical support to maintain the circuit boards in a stacked parallel configuration. Further, by means of the engagement of the ground shield plates 60 with the second contact terminal members 42, which are electrically interconnected to the ground planes within each of the circuit boards, continuous ground protection and shielding from board to board is attained.

Accordingly, there has been disclosed an improved electrical connector assembly which functions to provide electrical interconnections between circuit boards, provide shielding for the connections, and provide support for circuit boards which are arrayed in a stacked parallel configuration. While a preferred embodiment has been disclosed herein, it is understood that various modifications and adaptations to the disclosed embodiment are possible, and it is only intended that this invention be limited by the scope of the appended claims.

We claim:

1. An electrical connector assembly for interconnecting a plurality of circuit boards (10, 12) in a stacked parallel configuration, each of said circuit boards being formed with an array of apertures (35) therethrough which are located on the boards so that the apertures of said plurality of circuit boards are mutually registered when said plurality of circuit boards are positioned in said stacked parallel configuration, said electrical connector assembly comprising:

a receptacle member (14) including:

a housing (18) having a mating face (20), a mounting face (22), a transverse wall (24) extending along said mounting face, an inner body portion (26), and at least one outer side wall (28) extending from said mounting face to said mating face and defining at least one elongated cavity (30) between said inner body portion and said at least one outer side wall;

means (32) for mounting said housing to a first of said plurality of circuit boards with said mounting face engaging a first surface of said first circuit board;

said inner body portion (26) having a plurality of terminal-receiving passageways (34) extending therethrough from said mating face to said mounting face, each of said passageways being aligned with a respective one of the apertures (35) through said first circuit board when said housing is mounted to said first circuit board;

a plurality of first contact terminal members (36) each disposed in a respective terminal-receiving passageway (34) of said inner body portion (26), each of said first contact terminal members (36) having an elongated pin portion (38) extending beyond said mounting face and through a respective aperture of said first circuit board when said housing is mounted to said first circuit board, each of said first contact terminal members (36) further having a pin receiving portion (40) exposed along said mating face for mating with a corresponding pin portion (38) from a second receptacle member mounted to a second of said plurality of circuit boards; and a plurality of second contact terminal members (42) disposed in said transverse wall (24) and each having a terminal portion (44) extending into said at least one elongated cavity (30); and a pin shroud member (16) including: a housing (46) having a mating face (48), a mounting face (50), and at least one wall (52) extending from said mating face to said mounting face, said at least one wall surrounding a defined space;

means (58) for mounting said pin shroud member housing to said first circuit board with said mounting face of said pin shroud member housing engaging a second surface of said first circuit board and positioned so that the pin portions (38) of said first contact terminal members (36) which extend through the circuit board apertures (35) from the receptacle member (14) mounted to the first surface of said first circuit board extend through said defined space surrounded by said at least one wall (52); and at least one ground shield member (60) disposed along the outer periphery of said at least one wall (52);

said at least one wall (52) being adapted to be received in the at least one elongated cavity (30) of a third receptacle member (14) mounted to a third of said plurality of circuit boards so that said at least one ground shield member (60) engages the terminal portions (44) of the second contact terminal members (42) of said third receptacle member (14) when said pin shroud member (16) and said third receptacle member (14) are mated to interconnect said first and third circuit boards.

2. The electrical connector assembly according to claim 1 wherein the at least one ground shield member (60) includes a plurality of spaced pin portions (62) extending through respective apertures of said first circuit board for connection to a ground plane on said first circuit board and each of the second contact terminal members (42) further includes a pin portion (64) extending beyond said mounting face (22) of said receptacle member housing (18) and through a respective aperture of said first circuit board for connection to said ground plane on said first circuit board, the apertures for the ground shield member pin portions being interleaved with the apertures for the pin portions of the second contact terminal members.

3. The electrical connector assembly according to claim 1 wherein said receptacle member housing (18) includes two outer side walls (28) extending parallel to each other on opposite sides of said inner body portion (26) to form two elongated linear cavities (30) and said at least one wall (52) of said pin shroud member housing (46) includes two parallel wall segments (54) each adapted to be received in a respective one of the two elongated linear cavities (30) of the receptacle member housing (18).

4. The electrical connector assembly according to claim 3 wherein said at least one ground shield member includes two ground shield plates (60) each disposed along a respective one of the two pin shroud housing parallel wall segments (54).

5. The electrical connector assembly according to claim 4 wherein each ground shield plate (60) includes a plurality of spaced pin portions (62) extending through respective apertures of said first circuit board for connection to a ground plane on said first circuit board and each of the second contact terminal members (42) further includes a pin portion (64) extending beyond said mounting face (22) of said receptacle member housing (18) and through a respective aperture of said first circuit board for connection to said ground plane on said first circuit board, the plurality of second contact terminal members (42) being divided into two groups each extending into a respective one of the two elongated linear cavities (30), the apertures for the pin portions (62) of each ground shield plate (60) being arranged along a straight line and alternating with the apertures for the pin portions (64) of a respective group of the second contact terminal members (42).

6. The electrical connector assembly according to claim 1 wherein said pin shroud member housing (46) further includes a transverse wall (66) extending along said mounting face (50) of said pin shroud member housing (46) within the defined space surrounded by said at least one wall (52), said transverse wall (66) of said pin shroud member housing being formed with a plurality of passageways (68) therethrough, said passageways (68) of said pin shroud member housing transverse wall (66) being transverse to said mounting face (50) and being so positioned and spaced to be in registration with respective apertures (35) of said first circuit board so that each of the pin portions (38) of the first contact terminal members (36) which extends through a respective first circuit board aperture (35) from the receptacle member (14) mounted to the first surface of said first circuit board passes through a respective pin shroud member housing transverse wall passageway (68).

* * * * *